US006612348B1

(12) United States Patent
Wiley

(10) Patent No.: US 6,612,348 B1
(45) Date of Patent: Sep. 2, 2003

(54) FLUID DELIVERY SYSTEM FOR A ROAD VEHICLE OR WATER VESSEL

(76) Inventor: Robert A. Wiley, 2 Morningside Dr., Topsfield, MA (US) 01983

( * ) Notice: Subject to any disclaimer, the term of this patent is extended or adjusted under 35 U.S.C. 154(b) by 0 days.

(21) Appl. No.: 10/128,819

(22) Filed: Apr. 24, 2002

(51) Int. Cl.[7] ..... B63B 17/00

(52) U.S. Cl. ..... 141/231; 141/18; 141/114; 141/382; 222/608; 222/628; 222/92; 222/105; 114/343; 114/364

(58) Field of Search ..... 141/2, 18, 21, 141/114, 231, 382; 222/92, 105–107, 608–610, 628; 114/343, 364, 382

(56) References Cited

U.S. PATENT DOCUMENTS 4,109,604 A * 8/1978 Reed ..... 114/61.1
4,216,558 A * 8/1980 Schultz ..... 114/343
4,676,280 A * 6/1987 Curiel ..... 141/1
5,247,973 A * 9/1993 Brown ..... 141/83
5,787,835 A * 8/1998 Remnant ..... 114/271
6,029,595 A * 2/2000 Bachmann ..... 114/125
6,094,758 A * 8/2000 Renfro ..... 5/118
6,176,279 B1 * 1/2001 Dahlin et al. ..... 141/231
6,186,713 B1 * 2/2001 Bonerb ..... 410/100
6,354,238 B1 * 3/2002 Molesworth et al. ..... 114/343

* cited by examiner

*Primary Examiner*—J. Casimer Jacyna
(74) *Attorney, Agent, or Firm*—Paul J. Cook

(57) ABSTRACT

A liquid delivery system for a marine vessel or a road vehicle is provided which comprises a flexible bladder for housing a liquid, a portable pump, a protective housing for the pump, a pump switch and conduits for connecting the bladder, the pump and a container for liquid or the vessel or vehicle.

32 Claims, 2 Drawing Sheets

FLUID DELIVERY SYSTEM FOR A ROAD VEHICLE OR WATER VESSEL

BACKGROUND OF THE INVENTION

This invention relates to a liquid delivery system for a road vehicle or a water vessel. More particularly, this invention relates to such a system which is portable and which does not require the vehicle or vessel to be positioned near the source of the liquid.

When preparing a road vehicle sufficiently large to provide a living space or water vessel for a trip it is common practice to load the vehicle with water which can be utilized for cooking and cleaning during the trip. Oftentimes, the loaded water must be replenished so that the trip can be continued. It is usual practice, in the case of a water vessel to move the vessel from its mooring to a dock near a source of water and to fill containers on the vessel such as with a hose or the like. This process is undesirable when the vessel is not in its home port since the mooring is free for use by other vessels thereby depriving the vessel of its mooring. The process is also undesirable since the dock near the source of water oftentimes is crowded with vessels. This combination increases the chances of colliding with another vessel. In addition, the process is undesirably time consuming.

The problems of providing a road vehicle with water are similar to those encountered with water vessels. The road vehicle must be transported from its parking space (mooring) to the source of water and then back to the mooring with the attendant possible loss of the parking space to another road vehicle.

Accordingly, it would be desirable to provide a system for delivering liquid to a marine vessel or a road vehicle which does not require departure of the vessel or vehicle from its mooring or parking space. In addition, it would be desirable to provide such a system which is portable and which does not require installation of a permanent delivery system that requires space on the vessel or vehicle.

SUMMARY OF THE INVENTION

The present invention provides a portable liquid delivery system for a marine vessel or road vehicle. The liquid delivery system includes a flexible sealed bladder utilized to store a liquid to be delivered. The liquid delivery system also includes a portable pump positioned within a protective housing through which extend an electrical line and a switch. The housing also optionally is provided with an extension to which a line can be attached. The pump and housing can be hung from the vessel or road vehicle so that it can be easily positioned relative to the bladder containing the liquid. The bladder containing the liquid is delivered to the marine vessel by a small boat (dinghy) which accompanies the vessel or it is delivered to a road vehicle by a car or truck which normally accompanies the road vehicle.

DESCRIPTION OF SPECIFIC EMBODIMENTS

Figure 1:
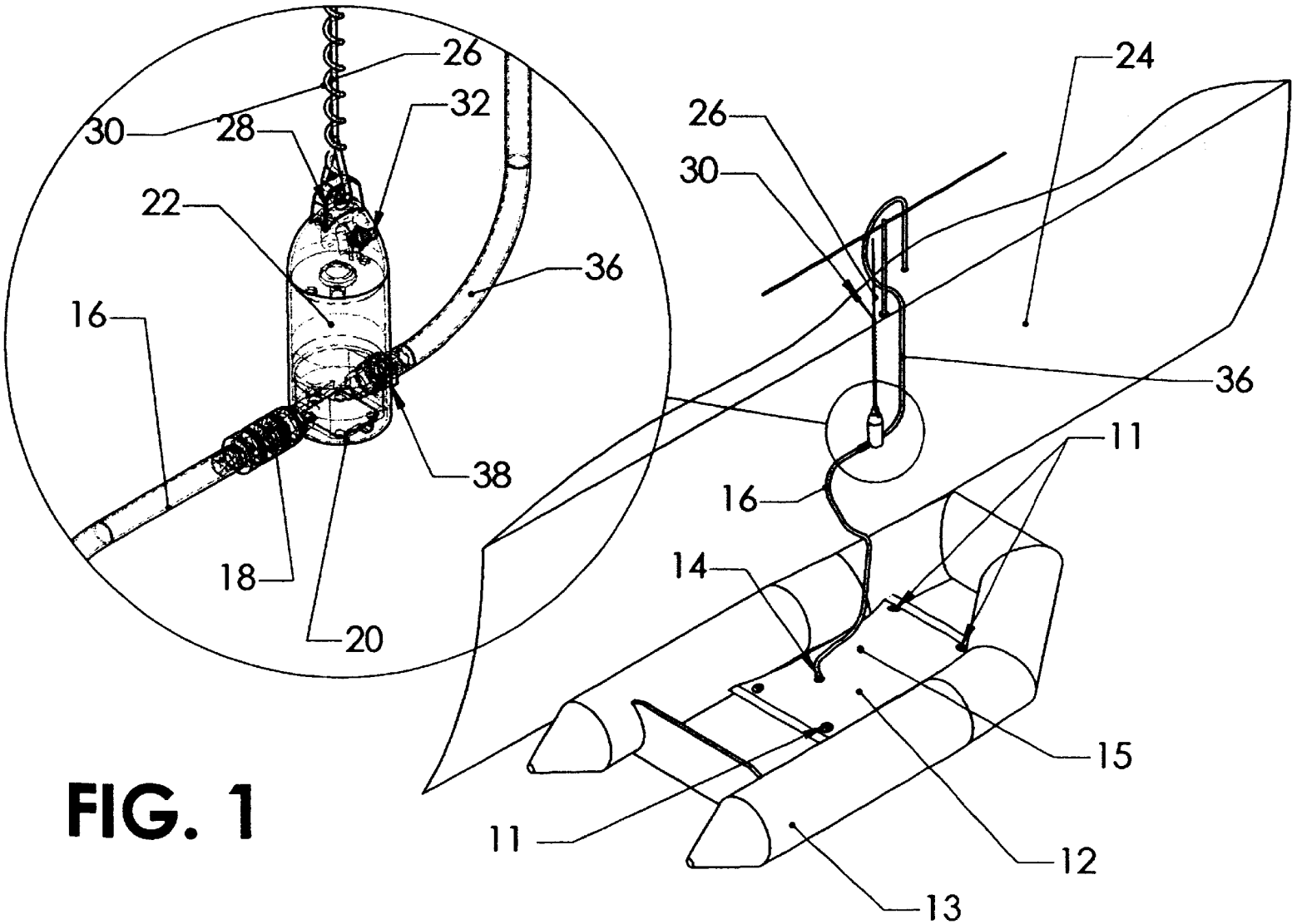
FIG. 1 is a perspective view of the system of this invention.

The liquid delivery system of this invention avoids the need of a moored marine vessel or parked road vehicle, when not being moved during use, to be moved to a source of liquid such as water or diesel fuel in order to take on the liquid. Thus, the system of this invention permits the marine vessel or road vehicle to remain at its mooring while the liquid is delivered to it in a flexible sealed bladder. Delivery of the filled bladder is made with an auxiliary boat (dinghy) of the marine vessel or a conventional car or truck which is secured to the marine vessel or road vehicle (towed) when the marine vessel or road vehicle is moving. It is necessary that the container for transporting the liquid be formed of flexible walls so that it can be easily filled or partially filled with the liquid in the substantial absence of air. It has been found that the flexible container permits movement of the liquid stored in the container without the formation of waves (sloshing) within the container. This characteristic is important since the formation of waves in the container would promote undesirable movement of the container within the dinghy, car or truck. This container movement is undesirable since such movement would greatly increase the possibility of leakage from the container, and vehicle instability.

Once the flexible container containing liquid is delivered to the marine vessel or parked road vehicle, a pump is positioned in fluid communication with the liquid in the container by a first conduit. A second conduit is connected to the pump and is in fluid communication with a container on the marine vessel or road vehicle. The pump is enclosed within a housing through the wall of which extend an electrical line which is connected to a source of electrical power on the marine vessel or road vehicle and an on-off switch with which an operator can activate or deactivate the pump. Alternatively, the electrical lines to the switch and to the source of electrical power can extend through an opening of the housing. Also, alternatively a portable source of electrical power such as a battery can be utilized to activate the pump. The switch permits activation or deactivation of the pump by a user located in the dinghy, car or truck rather than requiring the user to be positioned in the marine vessel or road vehicle. The switch need not be a mechanical switch but can be an electronic switch operated remotely by a radio frequency activator or the like. This feature facilitates use of the system of this invention. The protective housing optionally also is provided with an extension such as a loop or the like to which a flexible line such as a rope can be attached to it and also to a support on the vessel or vehicle. The rope can be attached to the housing by any other conventional means such as by being tied about the housing or the like. This permits the pump to be hung from any point on the vessel or vehicle so that the bladder containing the liquid can be positioned close to the container for the liquid on the vessel or vehicle. The housing is formed of a water proof mechanically strong material such as a polymer composition which protects the pump but does not damage the vessel or vehicle.

The protective housing optionally also has a space for housing electrical leads to the switch and to the source of electrical power. The optional space is sufficiently large to permit the electrical leads to pass through the housing to permit electrical attachment to the pump and subsequently to permit the pump and electrical leads to be inserted into the housing. By providing a pump housing which can be attached to a line and from which electrical leads can extend, the pump can be sufficiently small as to be portable so that it can be positioned at any point relative to the vessel or vehicle. This is particularly advantageous since space on the vessel or vehicle is usually at a premium and it is undesirable to fill space that renders difficult travel by a user of the space. In addition, in the case of a marine vessel, it may be buffeted by choppy seas causing rocking of the vessel that increases the chances of contact of the user and the pump. When the pump is capable of being hung over the side of the vessel, as is the case with this invention, such contact is diminished.

The bladder includes a connector to which a conduit extending from the pump can be connected. Optionally, loops for a rope or line can be attached to the bladder, such as with an adhesive or radio frequency welding.

Thus, the bladder containing the liquid can be tied to the dinghy, car or truck to substantially reduce the probability of the bladder being moved in the dinghy, car or truck during transportation to the vessel or vehicle. Typically, the bladder can contain about 50 to about 350 gallons. If desired, the bladder can have less or greater capacity than this range. A typically strong, flexible material for forming the bladder is a multilayer composite membrane formed of a base fabric coated on both sides with a polymer identified as X R-3 or XR-5 available from New World Manufacturing, Inc., Coverdale, Calif., 95425.

Referring to FIG. 1, the system 10 of this invention comprises a flexible bladder 12 which includes a connector 14 for conduit 16. The bladder 12 is positioned in dinghy 13 having optional relief valve 15. Optionally the bladder 12 can include loops 11 or the like which permit the bladder 12 to be tied to the dinghy 13. The conduit 16 also is connected to connector/valve 18 or pump 20 which is positioned within housing 22. The housing 22 is hung from marine vessel 24 and is attached to vessel 24 by line 26. Housing 22 optionally is provided with loop 28 formed integrally therewith for tying the line 26 to the vessel 24. Any other means for securing the line 26 to the housing 22, such as an adhesive can be utilized. Electrical line 30 provides electrical energy from the vessel 24 to the pump 20. Switch 32 is electrically connected to pump 20 in order to activate or deactivate pump 20.

Conduit 36 is connected to connector 38 of pump 20 to pass liquid from pump 20 to a liquid container (not shown) on vessel 24.

Figure 2:
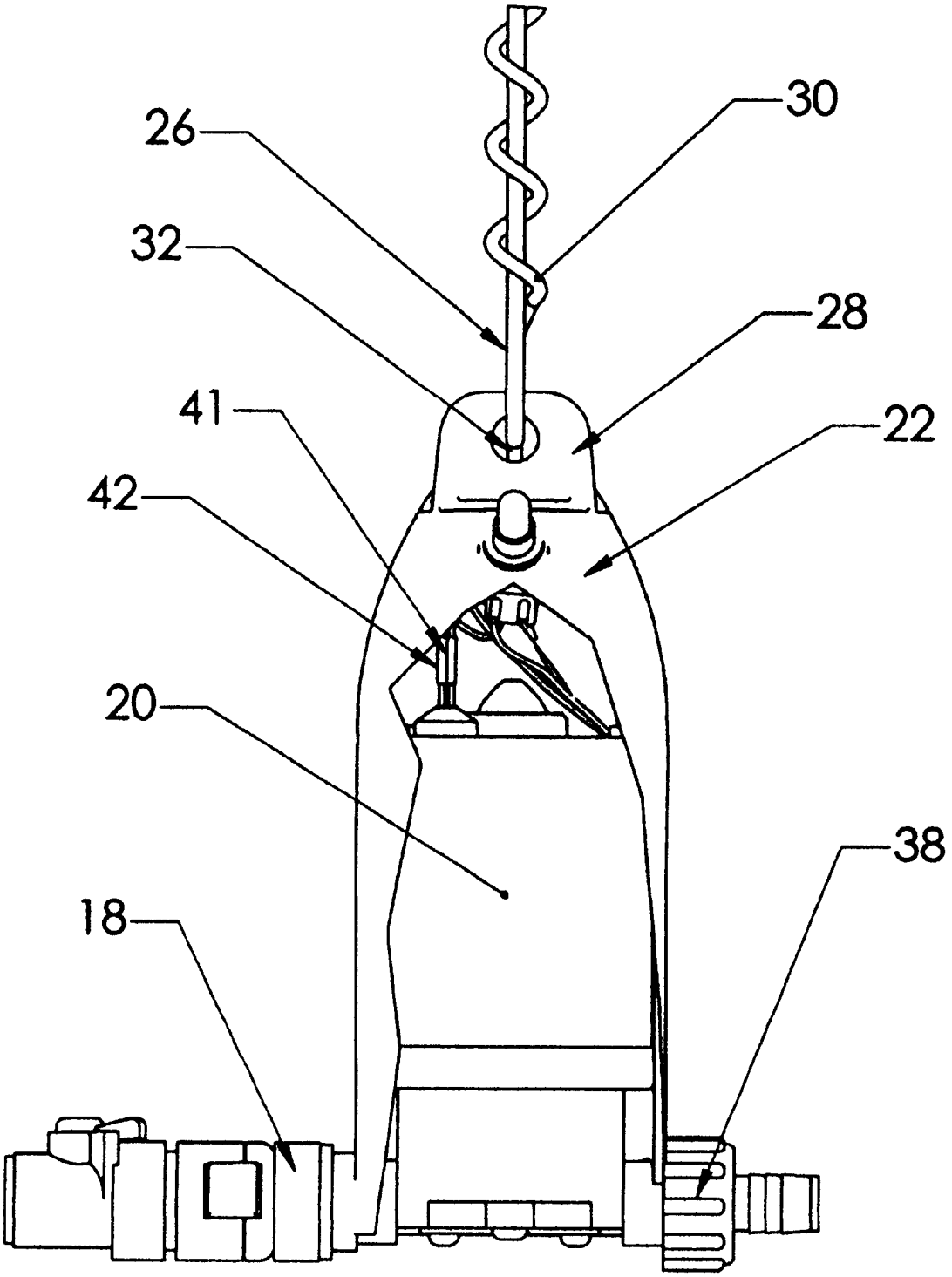
FIG. 2 is a partial cross-sectional view of a pump and housing for the pump of this invention.

Referring to FIG. 2, the pump 20 of this invention is shown enclosed by protective housing 22. The housing 22 includes a loop 28 to which line 26 is attached as well as on-off switch 32. Electrical leads 40 and 42 are electrically attached to pump 20 in order to activate or deactivate the pump 20. Electrical line 30 is electrically connected to an electrical power source on vessel 24.

When it is desired to activate the system 10 of this invention, conduits 16 and 36 are secured to connections 18 and 38. Line 16 is secured to connection 14 of flexible bladder 12. Conduit 36 is positioned in a container (not shown) for a liquid on vessel 24. Switch 32 is moved to an "on" position and the pump 20, such as an impeller pump is activated to move liquid from bladder 12 to the container (not shown) on the vessel 24. When the desired volume of liquid is moved to the container on the vessel 24, the switch 32 is moved to the "off" position. The conduits 16 and 36 then are decoupled from the pump 20 and bladder 12. All of the components then can be easily stored on the marine vessel or road vehicle.

The bladder 14 can be periodically cleaned such as with an aqueous solution of a vinegar (acetic acid).

It is to be understood that the system of this invention also could be used to transport other liquids such as diesel fuel. Such a system is particularly useful for a marine vessel.

What is claimed is:

1. A system for delivering a liquid to a marine vessel or a road vehicle which comprises:

a flexible bladder container for a liquid, said bladder having a first connection for a first conduit for transporting liquid, a pump having a second connection for said first conduit and a third connection, a protective container into which said pump is positioned, means for activating or deactivating the pump, said first conduit connected to said first connection and said second connection, and a second conduit connected to said third connection.

2. The system of claim 1 wherein said pump is an impeller pump.

3. The system of any one of claim 1 or 2 wherein said protective container includes an extension on an outside surface of said container, said extension having a configuration which permits tying a rope to said extension.

4. The system of claim 3 wherein said extension is a loop.

5. The system of claim 4 wherein said protective container includes a space for housing a first electrical line to said switch and a second electrical line to said pump.

6. The system of claim 5 wherein said bladder includes at least one extension on an outside surface of said bladder, said extension having a configuration which permits tying a rope to said extension.

7. The system of claim 6 wherein said bladder includes a plurality of said extensions.

8. The system of claim 5 wherein the switch is a mechanical switch.

9. The system of claim 5 wherein the switch is an electronic switch.

10. The system of claim 4 wherein said bladder includes at least one extension on an outside surface of said bladder, said extension having a configuration which permits tying a rope to said extension.

11. The system of claim 10 wherein said bladder includes a plurality of said extensions.

12. The system of claim 4 wherein the switch is a mechanical switch.

13. The system of claim 4 wherein the switch is an electronic switch.

14. The system of claim 3 wherein said protective container includes a space for housing a first electrical line to said switch and a second electrical line to said pump.

15. The system of claim 14 wherein said bladder includes at least one extension on an outside surface of said bladder, said extension having a configuration which permits tying a rope to said extension.

16. The system of claim 15 wherein said bladder includes a plurality of said extensions.

17. The system of claim 14 wherein the switch is a mechanical switch.

18. The system of claim 14 wherein the switch is an electronic switch.

19. The system of claim 3 wherein said bladder includes at least one extension on an outside surface of said bladder, said extension having a configuration which permits tying a rope to said extension.

20. The system of claim 19 wherein said bladder includes a plurality of said extensions.

21. The system of claim 3 wherein the switch is a mechanical switch.

22. The system of claim 3 wherein the switch is an electronic switch.

23. The system of any one of claim 1 or 2 wherein said protective container includes a space for housing a first electrical line to said switch and a second electrical line to said pump.

24. The system of claim 23 wherein said bladder includes at least one extension on an outside surface of said bladder, said extension having a configuration which permits tying a rope to said extension.

25. The system of claim 24 wherein said bladder includes a plurality of said extensions.

26. The system of claim 23 wherein the switch is a mechanical switch.

27. The system of claim 23 wherein the switch is an electronic switch.

28. The system of any one of claim 1 or 2 wherein said bladder includes at least one extension on an outside surface of said bladder, said extension having a configuration which permits tying a rope to said extension.

29. The system of claim 28 wherein said bladder includes a plurality of said extensions.

30. The system of claim 28 wherein the switch is a mechanical switch.

31. The system of any one of claim 1 or 2 wherein the switch is a mechanical switch.

32. The system of any one of claim 1 or 2 wherein the switch is an electronic switch.

* * * * *